US005890824A

United States Patent [19]

Loch

[11] Patent Number: 5,890,824

[45] Date of Patent: Apr. 6, 1999

[54] SOAP APPLICATOR

[76] Inventor: George N. Loch, Box 14, Glendon, Alberta, Canada, T0A 1P0

[21] Appl. No.: 951,559

[22] Filed: Oct. 16, 1997

[30] Foreign Application Priority Data

Oct. 17, 1996 [CA] Canada ..... 2188108

[51] Int. Cl.[6] ..... A45D 40/00

[52] U.S. Cl. ..... 401/6; 401/19; 401/27; 401/88; 401/138; 401/140

[58] Field of Search ..... 401/6, 88, 19, 401/27, 138, 140

[56] References Cited

U.S. PATENT DOCUMENTS

| | | | |
|---|---|---|---|
| D. 265,255 | 6/1982 | O'Neil | 401/6 X |
| D. 341,222 | 11/1993 | Corrigan | 401/6 X |
| 1,265,409 | 5/1918 | Wirth | 401/88 |
| 1,671,348 | 5/1928 | Creegan | 401/19 |
| 2,283,988 | 5/1942 | Heath | 401/6 |
| 4,861,180 | 8/1989 | Adams | 401/140 X |
| 4,896,984 | 1/1990 | Evans | 401/140 |
| 5,044,806 | 9/1991 | Nickelston | 401/6 X |

*Primary Examiner*—Steven A. Bratlie
*Attorney, Agent, or Firm*—Murray E. Thrift; Adrian D. Battison

[57] ABSTRACT

The soap applicator holds a bar of soap for application to areas of the body of a person, particularly those which are hard to reach. The soap applicator is in the form of a hand shaped soap holder with an elongate handle attached at its base. A recess in the soap holder receives the bar of soap and secures the soap with the use of two serrated flanges. Water is delivered through a tube to the soap holder from a reservoir in the handle. Curved massaging fingers extend from the soap holder in a direction out of the palm for lathering the soap and massaging the body.

10 Claims, 2 Drawing Sheets

SOAP APPLICATOR

FIELD OF THE INVENTION

The present invention relates to a soap applicator for holding and applying a bar of soap to an area of the body of a person, and particularly for applying soap to hard to reach areas of the body.

BACKGROUND OF THE INVENTION

When bathing or showering it can often be difficult to apply soap to all areas of the body such as portions of the back and other difficult to reach areas. This is particularly true for old or infirm individuals.

To enable an individual to reach all parts of the body scrubbing brushes have been mounted on the ends of elongate handles which enable the individual to apply the brush to areas of the body which otherwise are difficult to reach by hand. These scrubbing brushes require that the brush head be wetted with water and that soap be applied to the brush before application to the person during washing. The wetting of the brush head and application of soap must be repeated periodically during washing if the brush is to continue delivering soap to the persons body. This does not allow for continuous washing and can at times be inconvenient.

SUMMARY OF THE INVENTION

According to one aspect of the invention there is provided a soap applicator for holding a bar of soap and applying said soap to an area of a body of a person, said bar of soap having at least one side, said soap applicator comprising:

- a soap holder having opposed ends, and a first face extending between the ends;
- a recess in the first face sized and arranged to receive a first portion of a bar of soap therein and such that a second portion of said bar of soap projects outwards from said face;
- securing means for securing a bar of soap in place within the recess; and
- an elongate handle fixed to one of the ends of the soap holder extending therefrom to a free end.

The bar of soap is secured in such a manner that when the soap is used up another bar of soap can be secured to the soap holder thereby allowing the soap applicator to be reused over an extended period of time.

The soap applicator preferably includes a water reservoir within the elongate handle for storing water therein, and water communicating means for communicating water to the soap holder for wetting a bar of soap secured thereon. This allows for continuous wetting of the soap during use of the device without the need for stopping to wet the soap in the shower or bath.

The soap applicator preferably includes at least one massaging member extending from the soap holder in a direction outwards and away from the soap holder to a position spaced from the first face. The at least one massaging member enables the person bathing to work the soap as well as to massage the portion of the body being washed.

Preferably the securing means comprise a member having a serrated edge arranged to extend outwards from the recess for penetrating a side of a bar of soap thereby securing the bar of soap on the soap holder.

BRIEF DESCRIPTION OF THE DRAWINGS

In the accompanying drawings, which illustrate an exemplary embodiment of the present invention.

DETAILED DESCRIPTION

Figure 1:
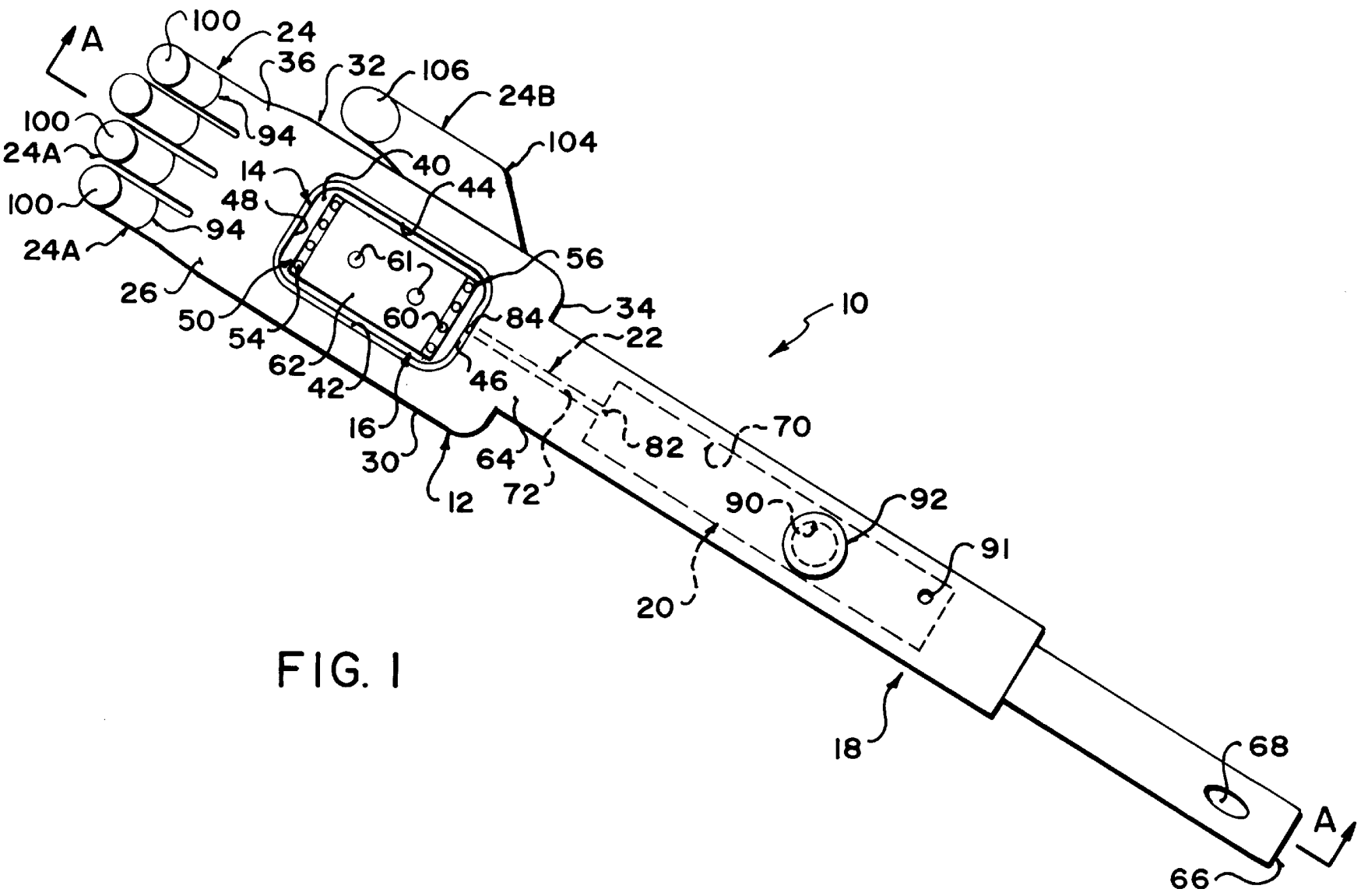
FIG. 1 shows a top view of the soap applicator.
Figure 2:
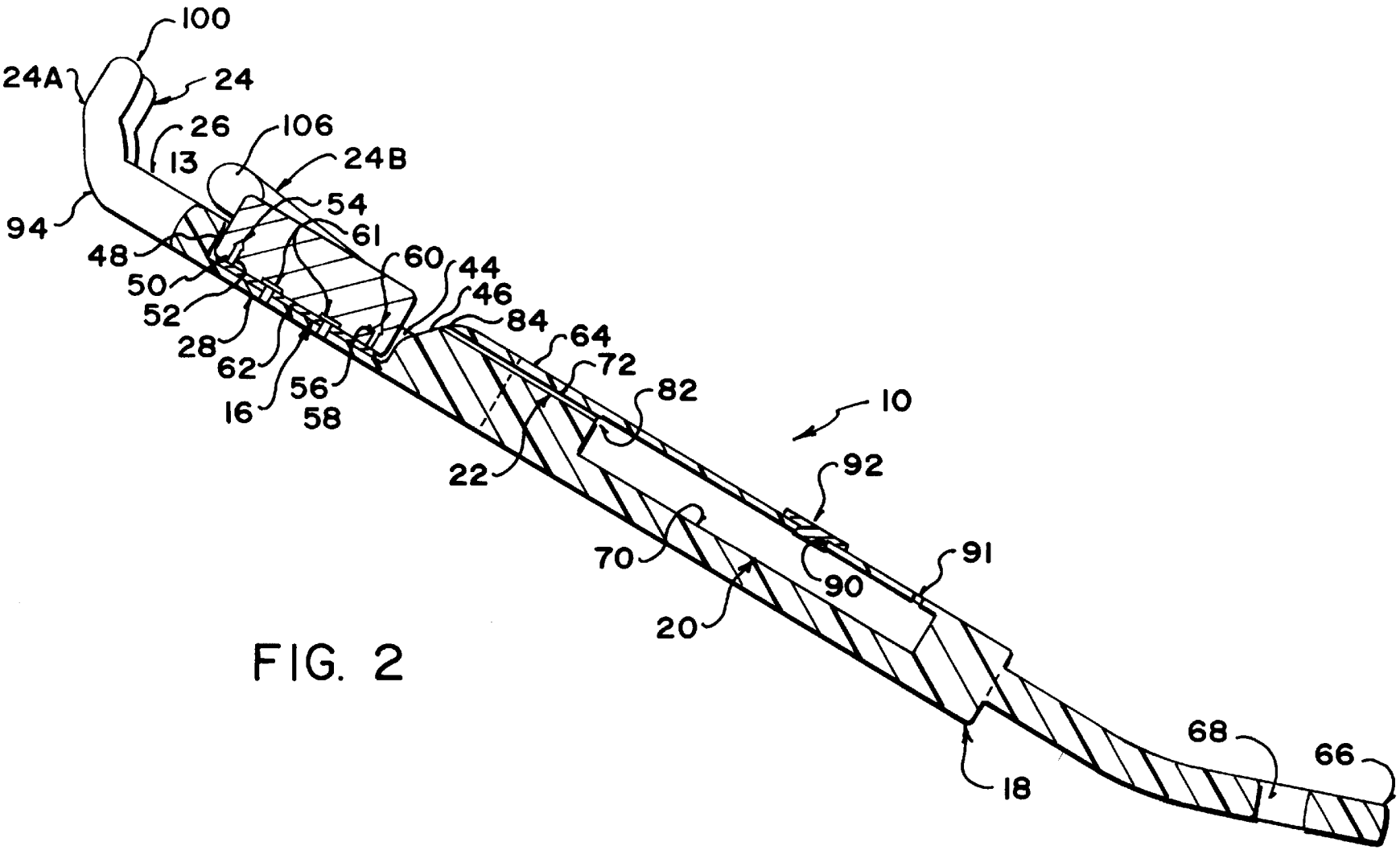
FIG. 2 shows a cross sectional view of the soap applicator through line A—A of FIG. 1.

Referring to FIGS. 1 and 2 the soap applicator is shown generally at 10. The soap applicator 10 comprises a soap holder 12, a recess 14 in the soap holder 12 for receiving a bar of soap 13 therein, securing means 16 for securing the bar of soap 13 within the recess 14, an elongate handle 18 fixed to the soap holder 12, a water reservoir 20, water communicating means 22, and at least one massaging member 24.

The soap holder 12 allows the user to secure a bar of soap 13 on the soap applicator for use while bathing. The bar of soap 13 is secured in such a manner that when the soap is used up another bar of soap can be secured to the soap holder 12 thereby allowing the soap applicator 10 to be reused over an extended period of time.

In the embodiment illustrated the soap holder 12 is formed to resemble a human hand which gives it a pleasing and interesting shape. The soap holder 12 includes a first face 26 arranged to form the palm of the hand, a second face 28 spaced from and arranged to lie substantially parallel to the first face 26, a first side 30, and second side 32 each extending along the length of the first and second faces 26 and 28 forming the sides of the hand, and first and second ends 34 and 36 arranged opposite each other and extending laterally across the first and second faces 26 and 28 enclosing the portion of the hand adjacent the heel of the palm and adjacent the fingers respectively. The soap holder 12 is sized and arranged such that a standard bar of soap 13 will fit in the palm of the hand and such that the soap holder 12 is thicker at the first end 34 adjacent the palm of the hand and thinner at the second end 36 adjacent the fingers.

The recess 14 is arranged within the first face 26 of the soap holder 12 and is sized and shaped to receive either a rectangular or oval shaped bar of soap 13 therein. The recess 14 in the illustrated embodiment is substantially rectangular for receiving a rectangular bar of soap 13. The recess 14 includes a bottom wall 40 spaced downward from the first face 26 and arranged to lie substantially parallel thereto.

A pair of substantially parallel spaced apart side walls 42 and 44 extend downwards from the first face 26 to side edges of the bottom 40. Likewise a pair of spaced apart substantially parallel end walls 46 and 48 extend downwards from the first face 26 and engage respective ends of the bottom wall 40. The recess 14 receives a lower portion of the bar of soap 13 thereby aligning and holding the bar of soap 13 in place on the soap holder 12. The recess 14 is spaced downwards from the first face 26 such that most of the bar of soap 13 projects upwards from the face such that when the soap applicator 10 is used the soap 13 can easily be applied to the body of a person.

The securing means 16 are arranged within the recess 14 and secure the bar of soap 13 within the recess 14. The securing means 16 include at least one member having a serrated edge which is arranged to extend from the recess in a direction outwards from the first face 26 for penetrating a side of the bar of soap 13 thereby securing the soap 13 on the soap holder 12.

The securing means 16 comprise a first member 50 and a second member 56 extending upwards from the bottom 40 of the recess, and a base member 62 extending therebetween. The first member 50 is arranged laterally across the soap holder 12 and parallel to the end wall 48 of the recess 14 and extending outwards from a bottom end 52 adjacent the bottom 40 of the recess 14 to a serrated top edge 54 spaced from the bottom 40 of the recess 14. The second member 56 is arranged laterally across the soap holder 12 and parallel to the end wall 46 of the recess 14 and extending outwards from a bottom end 58 adjacent the bottom 40 of the recess 14 to a serrated top edge 60 spaced from the bottom 40 of the recess 14. The base member 62 extends between the first and second members 50 and 56 and is spaced downwards from the respective top ends 54 and 60 thereof. Fixing means 61 such as tabs, rivets, or screws fix the securing means to the bottom 40 of the recess 14.

The elongate handle 18 is fixed at its first end 64 to the first end 34 of the soap holder 12 and extends from the first end 34 outwards to a free end 66. The handle 18 curves out of the plane of the first face 26 in a direction away from the first face 26. A hole 68 is provided near the free end 66 of the handle 18 and extends through the handle 18. The hole 68 allows the applicator 10 to be stored by hanging it on a hook or similar device when not in use.

To ensure that the soap 13 is always wetted a water reservoir 20 and water communicating means 22 are provided which deliver water to a bar of soap 13 secured on the soap holder 12. The water reservoir 20 is provided by a cavity 70 within the elongate handle 18 and extends along an interior portion of the handle 18. The water communicating means 22 comprise an elongate tube 72 extending from a first end 82 connected to the water reservoir 20 to a second end 84. The water communicating means 22 extends along the elongate handle 18 through the first end 34 of the soap holder 12 to a position in the portion of the soap holder 12 which lies adjacent the wall 46 at the recess 14 and above the first face 26 of the soap holder 12. From this position water from the cavity 70 can travel along the elongate tube 72 from its first end 82 to its second end 84 onto a bar of soap 13 within the recess 14.

The water reservoir 20 includes a filling hole 90 Which extends through a wall of the elongate handle 18 and into the cavity 70 allowing water to be poured through the hole 90 and into the cavity 70. A cap 92 or other removable and reengagable closure means is provided for cooperation with the hole 90 such that the cap 92 can be removed from the hole 90 allowing water to be poured into the cavity 70 and then replaced over the hole 90 sealing off the reservoir 20. This allows the person using the soap applicator 10 to fill the reservoir 20 with water, prior to use, instead of continuously wetting the soap 13.

The water reservoir 20 includes an air hole 91 which allows air to get into the cavity 70 as the water leaves thereby allowing water to continue to flowout until the cavity 70 is empty.

One or more massaging members 24 may be included on the soap applicator 10, in this case five one for each of the digits on the hand, are provided. The massaging members 24 extend from the soap holder 12 outwards away from the first face 26 in the same direction as the soap extends from the recess 14 and as the handle 18 curves upwards from the soap holder 12. The massaging members 24 extend in this direction away from the soap holder 12 to a position spaced from the first face 26. Four massaging members 24 provide the fingers of the hand and one massaging members 24 forms the thumb of the hand. Each of the four massaging members 24*a* defining the fingers is an elongate member and extends outwards from the end 36 of the soap holder 12 in a direction away from the elongate handle 18 and lies substantially coplanar to the first face 26 extending to a first point 94 then curves away from the plane in a direction outwards and away from the first face 26 terminating at a free end 100 lying at a position spaced from the first face 26.

The massaging member 24*b* forming the thumb comprises an elongate member fixed to the side 32 of the soap holder 12 and extending laterally outwards therefrom to a first point 104 then angling in a direction towards the second end 36 of the soap holder 12 and outwards and away from the first face 26 in the same direction as the other massaging members 24 and terminates at a free end 106 lying at a position spaced from the first face 26.

In use a bar of soap 13 is positioned over the recess 14 in the soap holder 12 and is pushed onto the serrated top edges 54 and 60 of the securing means 16. This secures the bar of soap 13 on the soap holder 12 such that the soap projects upwards from the face of the soap holder 12 and can engage the body of a person. The cap 92 is removed from the hole 90 in the handle 18 and the reservoir 20 is filled with water. The cap 92 is then replaced over the hole 90 thereby sealing off the reservoir. The individual using the applicator 10 then grasps the handle 18 of the applicator 10 and applies soap to areas of the body by drawing the bar of soap 13 over the body.

As the applicator 10 is used water in the reservoir 20 travels through the tube 72 and exits the second end 90 of the tube 72 traveling over and wetting the bar of soap 13. The soap 13 is then worked by the ends of the massaging members 24 which project beyond the soap 13 thereby massaging and washing the area of the body. When the bar of soap 13 is consumed after repeated uses, a new bar of soap can be secured on the soap holder 12.

Although in the embodiment illustrated the soap holder 12 is shaped like a human hand this is not necessary. Where massaging members are used any shape which provides a good arrangement for the massaging members may be used.

In alternative arrangements the serrated edges 54 and 60 of the securing means 16 may be oriented in any appropriate direction within the recess 14.

In another alternative embodiment the elongate handle 18 may widen as it extends from its first end 64 adjacent the soap holder 12 to its free second end 66.

While one embodiment of the present invention has been described in the foregoing, it is to be understood that other embodiments are possible within the scope of the invention. The invention is to be considered limited solely by the scope of the appended claims.

I claim:

1. A soap applicator and massaging device for holding a bar of soap for application of said soap to an area of a body of a person while providing a massaging effect wherein the soap applicator and massaging device comprises:

a hand shaped soap holder having a palm, curved massaging fingers extending out of the palm, a curved massaging thumb extending out of the palm and a recess in the palm;

bar securing means for securing a bar of soap in place within the recess;

and an elongate handle extending from the base of the hand shaped soap holder wherein each finger or thumb comprises an elongate member having one end fixed to the soap holder at positions spaced from the elongate handle and extending outwards substantially coplanar to the palm of the soap holder to a first point then curving towards the palm in a direction the palm is facing to terminate at a free end lying at a position spaced from the palm.

2. A soap applicator and massaging device in accordance with claim 1 including a water reservoir means for storing water therein, and a water communicating means for communicating water to the soap holder for wetting a bar of soap secured thereon.

3. A soap applicator and massaging device in accordance with claim 2 wherein the water reservoir means comprise a cavity within the elongate handle.

4. A soap applicator and massaging device in accordance with claim 2 wherein the water communicating means comprise an elongate tube extending from a first end connected to the water reservoir means to a second end adjacent the recess in the soap holder.

5. A soap applicator and massaging device in accordance with claim 3 wherein the water communicating means comprise an elongate tube extending along the elongate handle from a first end connected to the water reservoir means to a second end spaced outwards from the palm of the soap holder and lying adjacent the recess.

6. A soap applicator and massaging device in accordance with claim 3 wherein the water reservoir means includes a filling hole extending through a wall of the elongate handle into the cavity and having a removable and reengagable closure means arranged for cooperation with the filling hole.

7. A soap applicator and massaging device in accordance with claim 1 wherein the elongate handle is curved in a direction outwards and away from the palm of the soap holder.

8. A soap applicator and massaging device in accordance with claim 1 wherein the securing means comprise a member having a serrated edge being arranged to extend from the recess for penetrating a bar of soap thereby securing said bar of soap on the soap holder.

9. A soap applicator and massaging device in accordance with claim 1 including a recess in the palm sized and arranged to receive a first portion of a bar of soap therein and such that a second portion of said bar of soap projects outwards from said palm, said recess having a bottom spaced inwards from the palm of the soap holder; and wherein the securing means comprise a first member arranged laterally across the soap holder and extending outwards from a bottom end adjacent the bottom of the recess to a serrated top end spaced from the bottom of the recess, a second serrated member arranged laterally across the soap holder and extending outwards from a bottom end adjacent the bottom of the recess to a serrated top end spaced from the bottom of the recess, a base member extending between the first and second serrated members and being spaced downwards from the top ends thereof, and fixing means for fixing the securing means within the recess.

10. A soap applicator and massaging device in accordance with claim 1 wherein the soap applicator comprises plastic material.

* * * * *